US005336109A

United States Patent [19]

Hillbish et al.

[11] Patent Number: 5,336,109

[45] Date of Patent: Aug. 9, 1994

[54] STACKED CONNECTOR ASSEMBLY

[75] Inventors: Warren C. Hillbish, Hummelstown; Steven G. Smith, Linglestown, both of Pa. 17112

[73] Assignee: The Whitaker Corporation, Wilmington, Del.

[21] Appl. No.: 47,849

[22] Filed: Apr. 15, 1993

[51] Int. Cl.[5] ..... H01R 13/73

[52] U.S. Cl. ..... 439/540

[58] Field of Search ..... 439/532, 540, 79

[56] References Cited

U.S. PATENT DOCUMENTS 4,818,239 4/1989 Erk ..... 439/55
4,878,856 11/1989 Maxwell ..... 439/540
5,044,984 9/1991 Mosser et al. ..... 439/540
5,080,609 1/1992 Fabian et al. ..... 439/540
5,085,590 2/1992 Galloway ..... 439/540
5,167,531 12/1992 Broschard, III et al. ..... 439/540

*Primary Examiner*—Gary F. Paumen
*Attorney, Agent, or Firm*—David L. Smith

[57] ABSTRACT

A stacked connector assembly is disclosed which includes two connectors attached to a bracket which, in turn, is attached to the surface of a printed circuit board. The bracket is of unitary construction and includes two side members interconnected by two lateral members. Openings are provided in the bracket through which solder tails of the two connectors extend. Each of the side members includes surface portions that mount to the connectors and to the printed circuit board.

14 Claims, 5 Drawing Sheets

STACKED CONNECTOR ASSEMBLY

The present invention relates to printed circuit board multi-contact connectors that are stacked to conserve board space and more particularly to a bracket for stacking two such connectors and the assembly thereof.

BACKGROUND OF THE INVENTION

Electronic circuitry contained on printed circuit boards of the type found in computers and other similar electronic equipment are usually interfaced to adjacent equipment by means of multi-contact electrical connectors. Such printed circuit boards are typically crowded with circuitry and related components making it necessary to conserve surface space. In certain instances two multi-contact connectors must be provided, such as for example, a control card for controlling a printer wherein the printer may have either a serial port or a parallel port. This requires two different connectors on the control card. Each of these connectors requires a certain amount of space on the board for electrically attaching the solder tails of the connector contacts to the control circuitry and, additionally, requires space for securing the two connectors to the board itself.

In an effort to economize board space in these instances where two electrical connectors are required to be mounted on the same printed circuit board, the two connectors may be vertically stacked, one over the other. An example of such a stacked arrangement is disclosed in U.S. Pat. No. 4,878,856 which issued Nov. 7, 1989 to Maxwell. There a pair of L-shaped brackets are arranged side by side on a printed circuit board with the two connectors mounted to the two vertical legs of the two brackets. An insulating block is provided between the two brackets having holes therethrough in registry with the solder tails of the connectors for guiding the tails to their points of contact with the board. Flared eyelets are used to attach the connectors to the two brackets, while the brackets are attached to the board by means of conventional boardlock devices. Another example of a stacked arrangement is disclosed in U.S. Pat. No. 5,044,984 which issued Sep. 3, 1991 to Mosser et al. Mosser et al. discloses a pair of cast or molded brackets that attach to the mounting flanges of two electrical connectors and also attach to the surface of a printed circuit board by means of conventional boardlock devices. The two brackets each have an eyelet extending through a through hole in the bracket and through holes in the connector flanges, the eyelets being flared to lock the assembly together. An insulated spacer plate is secured to the lower ends of the brackets and has holes for receiving and spacing the solder tails of the upper-most connector. Both of these arrangements include multiple parts that must be stocked and assembled, resulting in additional complexity and cost to manufacture. What is needed is a low cost, stacked connector assembly that has fewer parts and is simple to install to the printed circuit board.

SUMMARY OF THE INVENTION

A stacked connector assembly is disclosed having first and second connectors arranged vertically one above the other for mounting to a surface of a substrate. Each connector has solder tails adapted to be electrically connected to circuits on the substrate. The assembly includes a bracket of unitary construction having a first surface for receiving and positioning the first connector, a second surface for receiving and positioning the second connector, a third surface adapted to be mounted to the surface of the substrate, and means for securing the first and second connectors to the first and second surfaces respectively of the bracket.

DESCRIPTION OF THE PREFERRED EMBODIMENT

Figure 1:
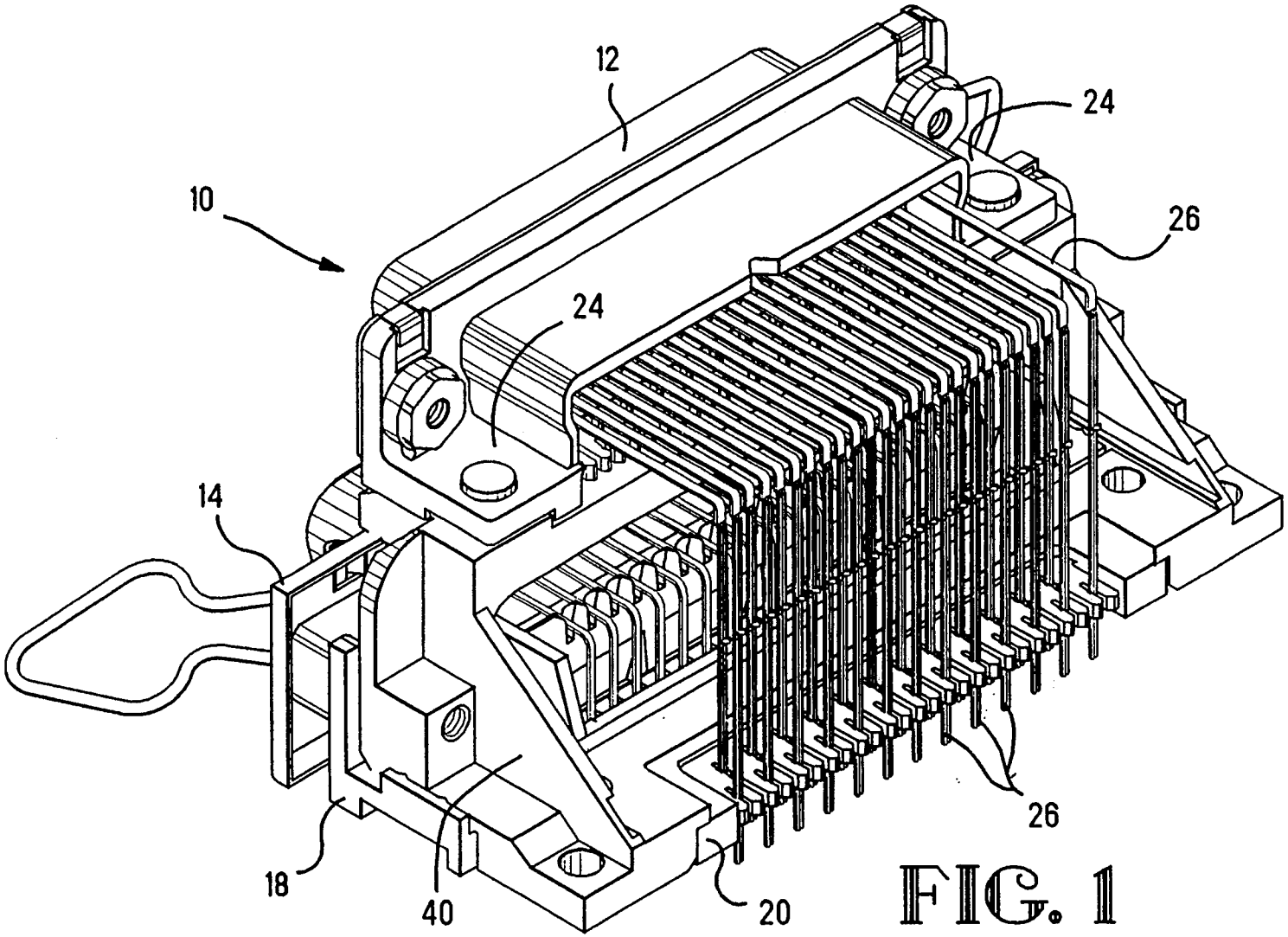
FIG. 1 is an isometric view of a stacked connector assembly incorporating the teachings of the present invention.
Figure 2:
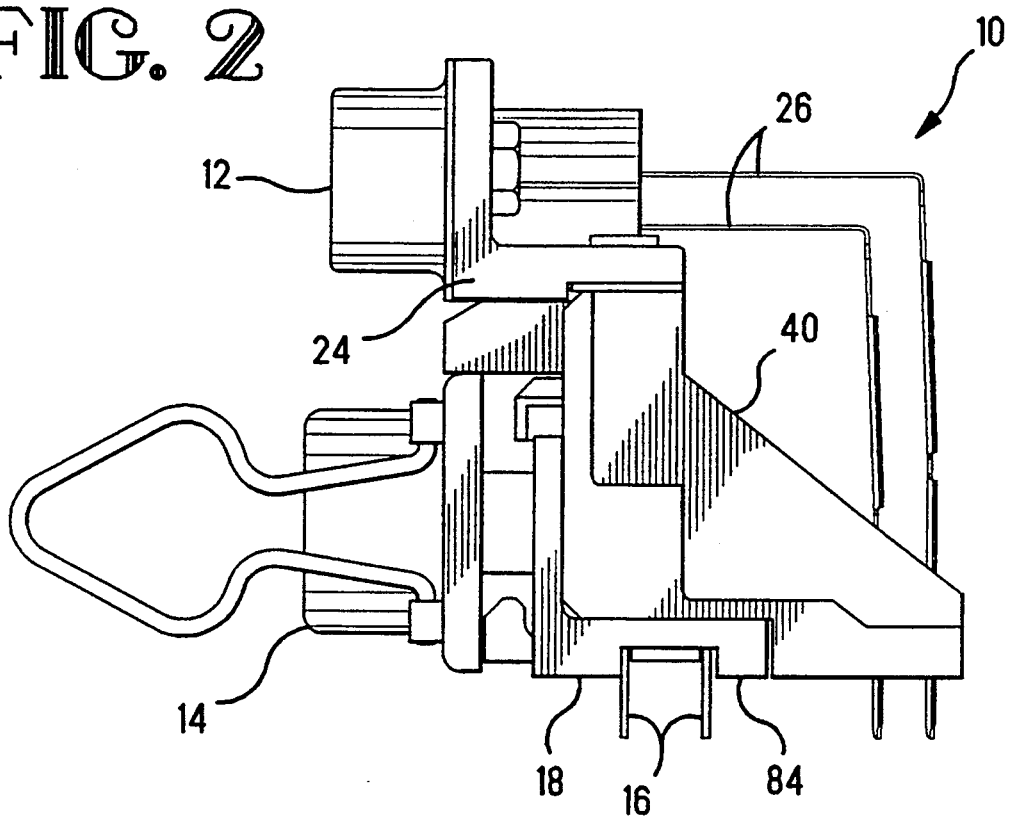
FIG. 2 is an end view of the assembly shown in FIG. 1.
Figure 3:
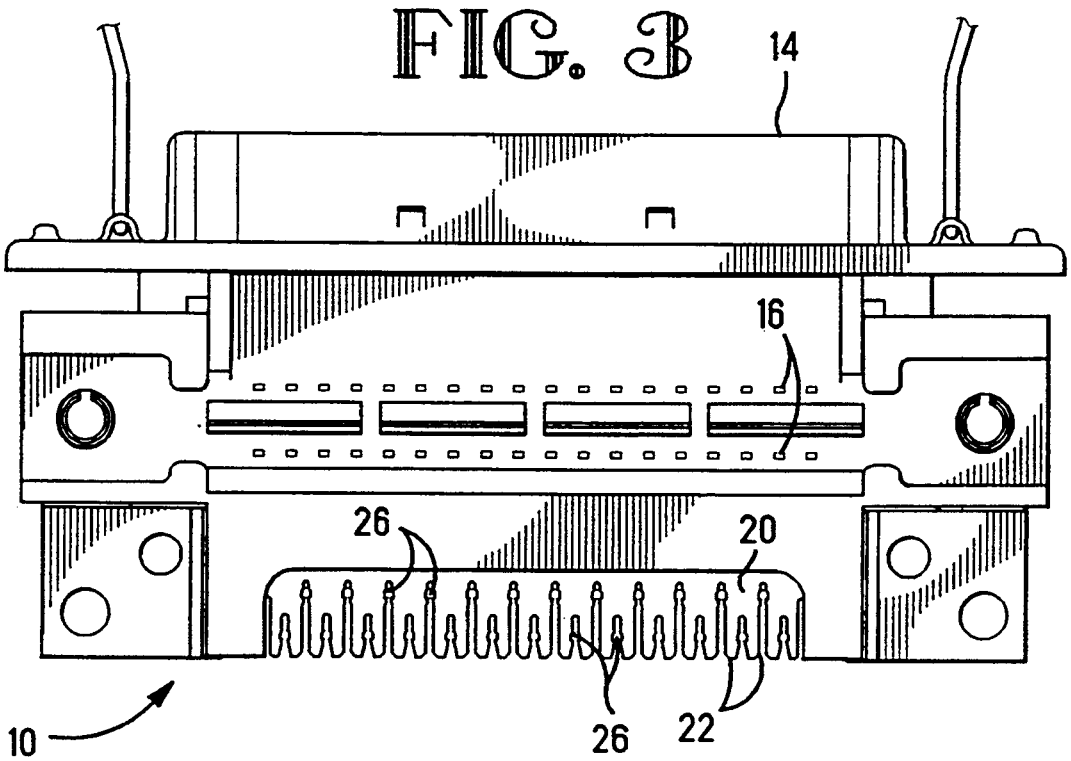
FIG. 3 is a bottom view of the assembly shown in FIG. 1.
Figure 4:
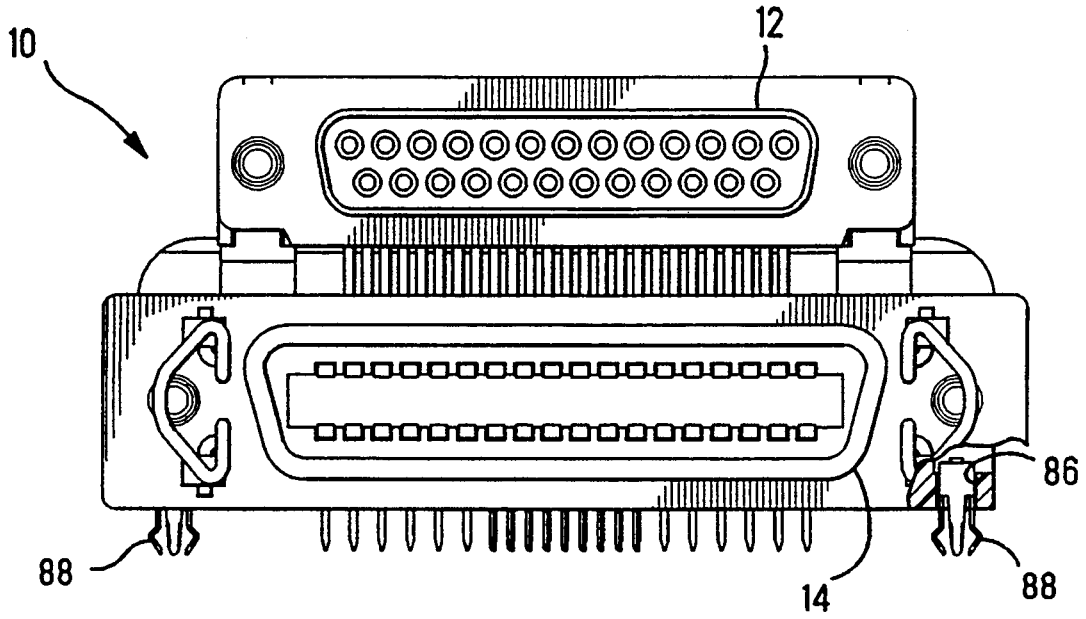
FIG. 4 is a front view of the assembly shown in FIG. 1.
Figure 5:
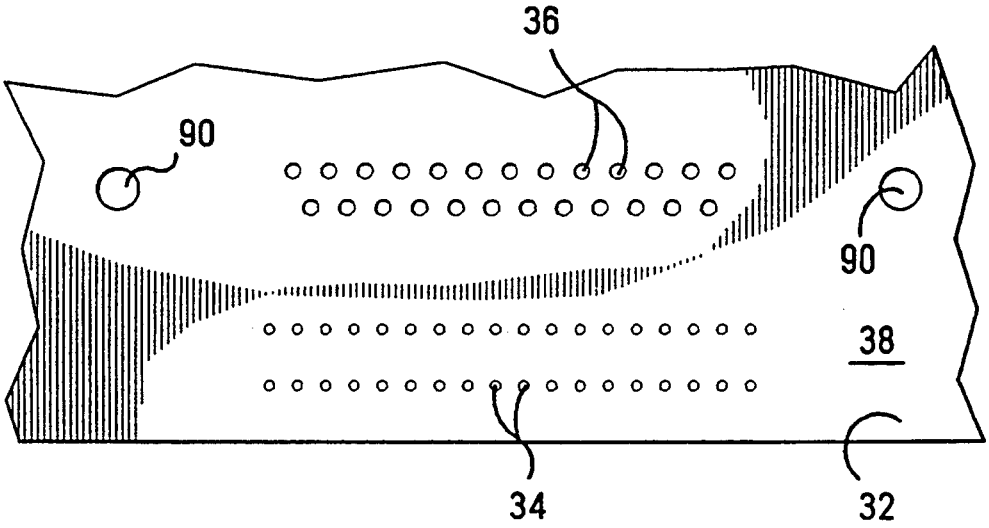
FIG. 5 is a plan view of a portion of a printed circuit board showing a hole layout for the present connector assembly.

There is shown in FIGS. 1, 2, 3, and 4 a stacked connector assembly 10 having a first connector 12 which, in the present example, is an AMPLIMITE HD-20 receptacle, and a second connector 14 which, in the present example, is a 36 position CHAMP receptacle, both connectors of which are manufactured under the trademarks AMPLIMITE and CHAMP by AMP Incorporated. It will be understood that the present invention is not limited to a connector assembly containing these particular two connectors, that these connectors are shown by way of example only and that any suitable connectors may be utilized. The second connector 14 has two rows of solder tails 16 which project downwardly from a mounting flange 18 that is part of the housing of the connector. The flange 18 includes an electrically insulating extension 20, as best seen in FIGS. 1 and 3, having a series of slots 22. The first connector 12 includes a mounting flange 24 and two rows of solder tails 26 which exit the rear of the connector and bend downwardly, extending through the slots 22 of the extension 20 as shown. The two connectors are mounted to a mounting bracket 30, in a manner that will be described, that in turn is arranged to be mounted to a printed circuit board 32 having plated through holes 34, 36 as shown in FIG. 5. The plated holes 34 and 36 are connected to circuitry on the board, not shown. The solder tails 16 and 26 are arranged to be inserted into the holes 34 and 36, respectively, and soldered in place in the usual manner. The connector assembly is secured to a surface 38 of the printed circuit board in a manner that will be described.

There is shown in FIGS. 6 through 9 a bracket 40 having a left side member 42 and a right side member 44 interconnected by first and second lateral members 46 and 48. A first surface is provided for receiving and positioning the mounting flange 24 of the first connector 12 and comprises two surface portions 50 and 52, one of which is formed integral with each of the right and left side members 42 and 44 respectively. The lateral member 46 joins the side members adjacent the first surface portions thereby rigidly interconnecting them.

A hollow projection 53 extends from each first surface portion 50 and 52, each in the form of a cylinder having an opening 54 in its side. The projections 53 are formed integral with the bracket 40. A locating feature 56 is associated with each of the first surface portions for engaging and positioning the first connector 12 when it is assembled thereto. The projections 53 extend upwardly through holes in the flange 24 and are rolled over to secure the first connector to the bracket 40 as shown in FIGS. 1 and 2. The opening 54 prevents the projection 53 from splitting during this rolling process.

A second surface is provided for receiving and positioning the mounting flange 18 of the second connector 14 and comprises two surface portions 60 and 62, one of which is formed integral with each of the right and left side members 42 and 44 respectively opposite the first surface portions 50 and 52. A hollow projection 63 extends from each second surface portion 60 and 62, each in the form of a cylinder having an opening 54 in the side. The projections 63 are formed integral with the bracket 40. A face 64 is formed on each side member of the bracket adjacent and normal to the second surface portions 60 and 62. When assembling the second connector to the bracket 40 the inside surfaces of the flange 18, which is L-shaped, are brought into engagement with the two second surface portions 60 and 62 and the faces 64. The two projections 63 extend through holes in the flange 18 and are rolled over to secure the second connector to the bracket 40 as shown in FIGS. 1 and 2. A pair of lugs 70 project from the side members 42 and 44 and are sandwiched between the lower surface of the flange 24 and the top of the housing of the first connector 12 thereby steadying the two connectors and providing a more rigid connector assembly. Each side member 42 and 44 includes a boss 72 having a threaded hole 74 for accepting a screw fastener of a connector that mates with the second connector 14.

A third surface is provided on the bracket 40 for mounting the stacked connector assembly to the surface 38 of the printed circuit board 32. The third surface comprises two spaced apart surface portions 80 and 82 which are formed integral with the respective side members 42 and 44. The third surface portions 80 and 82 are parallel to and spaced out of the plane of the second surface portions 60 and 62 by an amount substantially equal to the thickness of the lower leg of the flange 18 so that the bottom surface 84 of the flange is flush with the third surface portions, as best seen in FIG. 2. Each side member 42 and 44 includes a hole 86 for receiving a boardlock device 88 as shown in FIG. 4. The boardlock devices 88 are pressed into the holes 86 in the usual manner and are arranged to snap into holes 90 in the printed circuit board 32, thereby securing the stacked connector assembly 10 to the board 32. The lateral member 48 joins the side members adjacent the third surface portions thereby rigidly interconnecting them.

Figure 6:
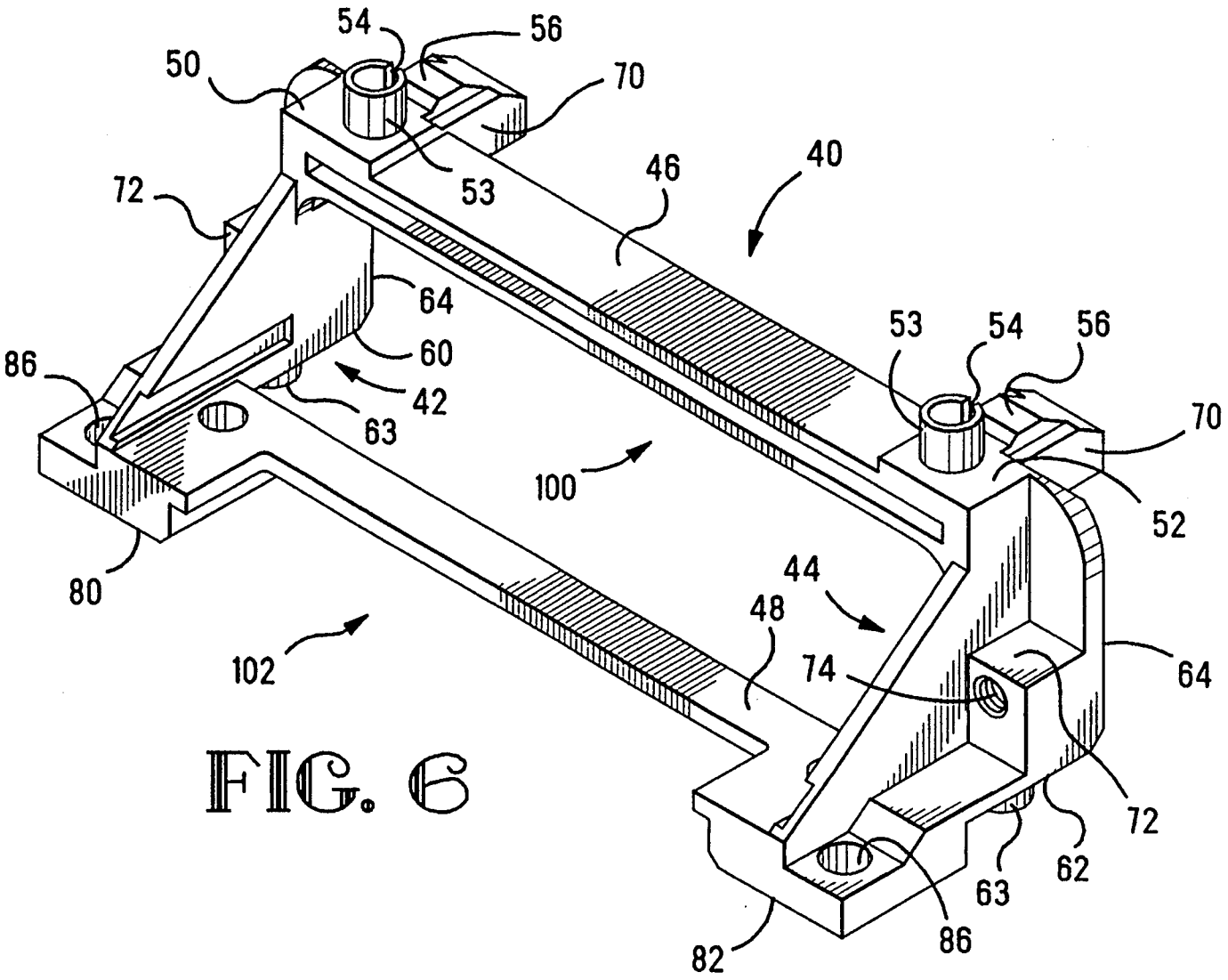
FIG. 6 is an isometric view of the bracket of the present connector assembly.
Figure 7:
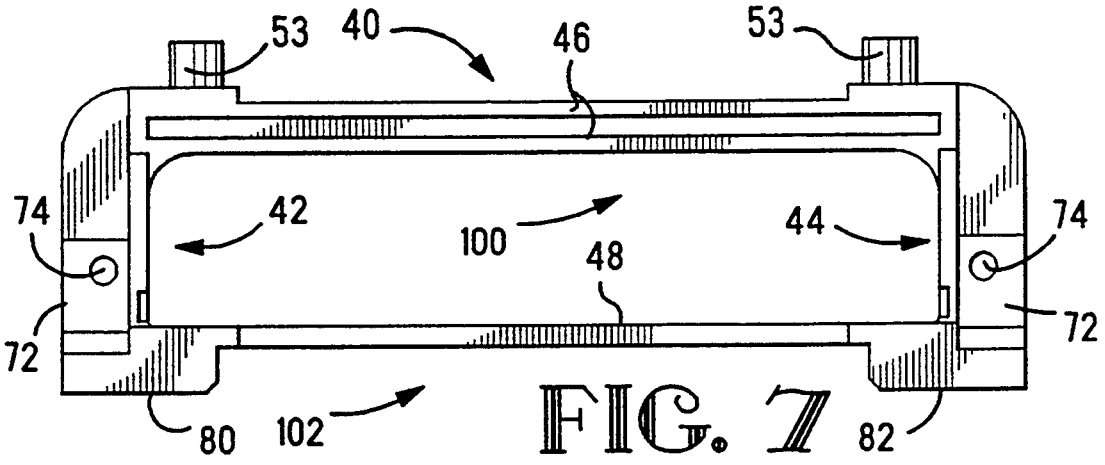
FIG. 7 is a rear view of the bracket shown in FIG. 6.
Figure 8:
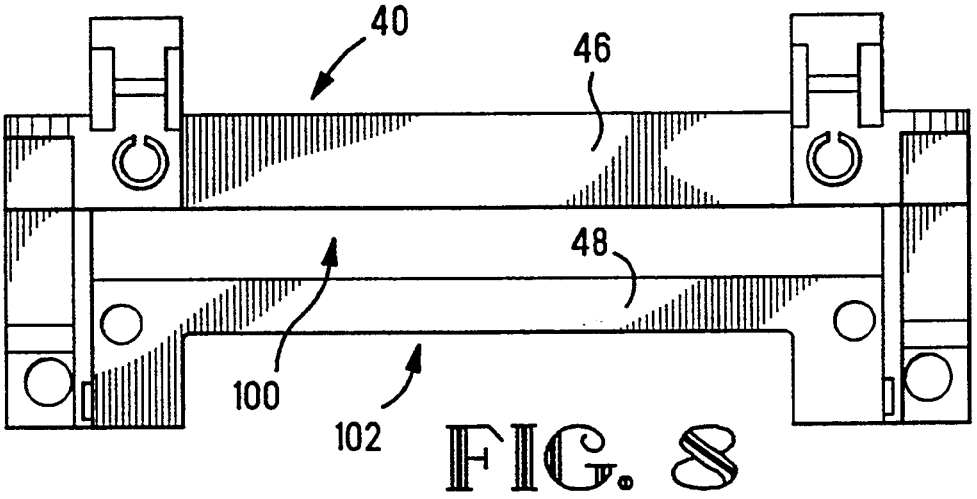
FIG. 8 is a plan view of that shown in FIG. 7.
Figure 9:
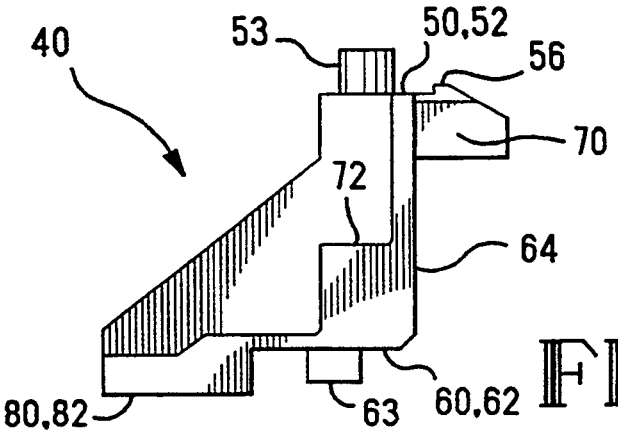
FIG. 9 is an end view of that shown in FIG. 7.

A first opening 100 is provided in the bracket 40 between the two lateral members 46 and 48 and the side members 42 and 44 into which a portion of the second connector 14 projects. The solder tails 16 of the second connector extend downwardly, as viewed in FIGS. 1 and 2, through the first opening 100 and into the plated through holes 34. A second opening 102 is provided in the bracket 40 between the two side members 42 and 44 adjacent the lateral member 48, as best seen in FIGS. 6, 7, and 8. The insulating extension 20 of the second connector 14 extends into the second opening so that the solder tails 26 engage the slots 22 and pass through the opening 102. The slots 22 hold and position the solder tails 26 for insertion into the plated through holes 34 in the printed circuit board 32. The insulating extension 20 thereby serves as a lead organizer for the solder tails.

The bracket, including the projections and lateral members, is of unitary construction for ease of assembly and economy of manufacture. It is preferably cast of an electrically conductive metal such as zinc alloy, or molded of a suitable plastic that is rendered electrically conductive by plating or some other means, or is formed of other suitable conductive material. It is important that the bracket be conductive so that the entire assembly can be grounded to the grounding circuit on the printed circuit board. The boardlock 88 is made of a spring material that is electrically conductive so that the bracket is electrically grounded to the printed circuit board 32. The two connectors 12 and 14 include grounding straps, not shown, that electrically engage the first and second surface portions, respectively, of the bracket 40 thereby grounding the two connectors to the board 32.

An important advantage of the present invention is that a stacked multi-contact electrical connector assembly is provided with the use of a minimum of separate parts while enabling the connectors to be positively secured together to provide a single unit for attachment to a printed circuit board. Since the boardlock device is inserted into the bracket during manufacture thereof, there are only three parts for final assembly, the two connectors and the bracket. This greatly economizes the manufacturing process. Another important advantage of the present invention is that one or both of the stacked connectors may be easily grounded to circuitry on the printed circuit board. And the stacking of the two connectors results in a substantial savings of scarce board space.

I claim:

1. A stacked electrical connector assembly having first and second electrical connectors arranged vertically one above the other for mounting to a surface of a substrate, each connector having solder tails adapted to be electrically connected to circuits on said substrate, the assembly including a bracket of unitary construction having a first surface for receiving and positioning said first connector, a second surface for receiving and positioning said second connector, a third surface adapted to be mounted to said surface of said substrate, projections integral with said bracket for securing said first and second connectors to said first and second surfaces respectively, said bracket including a first opening through which said solder tails of said second connector extend and a second opening through which said solder tails of said first connector extend, said solder tails of said first and second connectors extending past said third surface.

2. The connector assembly according to claim 1 wherein said integral projections extend through holes in said first and second connectors.

3. A stacked connector assembly as recited in claim 1, and further comprising: projections formed integral with said bracket, said projections being deformable by being rolled over portions respectively of said first and second connectors for securing said first and second connectors to said first and second surfaces respectively.

4. A stacked connector assembly as recited in claim 3, and further comprising: openings in sides of said projections preventing the projections from splitting, and the projections projecting through holes in said first and second connectors respectively.

5. A stacked electrical connector assembly having first and second electrical connectors arranged vertically one above the other for mounting to a surface of a substrate, each connector having solder tails adapted to be electrically connected to circuits on said substrate, the assembly including a bracket of unitary construction having a first surface for receiving and positioning said first connector, a second surface for receiving and positioning said second connector, a third surface adapted to be mounted to said surface of said substrate, and integral portions of said bracket for securing said first and second connectors to said first and second surfaces respectively, said bracket including left and right spaced apart side members, said first surface including two spaced apart first surface portions, one of which is integral with one of said side members and the other of which is integral with the other of said side members, and said second surface including two spaced apart second surface portions, one of which is integral with one of said side members and the other of which is integral with the other of said side members opposite said first surface portions, said left and right side members being interconnected with a first lateral member formed integral therewith adjacent said first surface portions, said third surface includes two spaced apart third surface portions, one of which is integral with one of said side members and the other of which is integral with the other of said side members, said left and right side members being interconnected with a second lateral member formed integral therewith adjacent said third surface portions, said bracket includes a first opening through which said solder tails of said first connector extend, a second opening through which said solder tails of said second connector extend, and said second connector includes a lead organizer of dielectric material attached thereto which projects into said second opening and engages said solder tails of said first connector.

6. The connector assembly according to claim 5 wherein one of said third surface portions includes a boardlock device for securing said bracket to said surface of said substrate.

7. The connector assembly according to claim 5 wherein said first connector is different from said second connector.

8. A stacked connector assembly as recited in claim 5, and further comprising: projections formed integral with said bracket, said projections being deformable by being rolled over portions respectively of said first and second connectors for securing said first and second connectors to said first and second surfaces respectively.

9. A stacked connector assembly as recited in claim 8, and further comprising: openings in sides of said projections preventing the projections from splitting, and the projections projecting through holes in said first and second connectors respectively.

10. A bracket of unitary construction for positioning and holding first and second electrical connectors arranged vertically one above the other and mounting them to a surface of a printed circuit board, each connector having solder tails adapted to be electrically connected to circuits on said printed circuit board, comprising:

(a) left and right spaced apart side members, (b) two spaced apart first surface portions for receiving and positioning said first connector, one of said portions being integral with one of said side members and the other of said portions being integral with the other of said side members, (c) two spaced apart second surface portions for receiving and positioning said second connector opposite said first surface portions, one of said portions is integral with one of said side members and the other of said portions is integral with the other of said side members, said left and right side members being interconnected with a first lateral member formed integral therewith adjacent said first surface portions, (d) two spaced apart third surface portions adapted to be mounted to said surface of said printed circuit board, one of said portions is integral with one of said side members and the other of said portions is integral with the other of said side members, said left and right side members being interconnected with a second lateral member formed integral therewith adjacent said third surface portions, said bracket including a first opening through which said solder tails of said first connector extend and a second opening through which said solder tails of said second connector extend, and said second connector including a lead organizer of dielectric material attached thereto which projects into said second opening and engages said solder tails of said first connector.

11. The bracket according to claim 10 wherein one of said third surface portions includes a boardlock device for securing said bracket to said surface of said printed circuit board.

12. The bracket according to claim 10 wherein said bracket is electrically conductive.

13. A bracket as recited in claim 10, and further comprising: projections formed integral with said bracket, said projections being deformable by being rolled over portions respectively of said first and second connectors for securing said first and second connectors to said first and second surfaces respectively.

14. A bracket as recited in claim 13, and further comprising: openings in sides of said projections preventing the projections from splitting, and the projections projecting through holes in said first and second connectors respectively.

* * * * *